US011626059B2

(12) United States Patent
Zhang et al.

(10) Patent No.: US 11,626,059 B2
(45) Date of Patent: Apr. 11, 2023

(54) DISPLAY DEVICE AND DISPLAY CONTROL METHOD AND DISPLAY CONTROL APPARATUS THEREOF

(71) Applicants: HEFEI BOE DISPLAY TECHNOLOGY CO., LTD., Anhui (CN); BOE TECHNOLOGY GROUP CO., LTD., Beijing (CN)

(72) Inventors: Chunheng Zhang, Beijing (CN); Yizhan Han, Beijing (CN); Jun Wang, Beijing (CN); Jianwei Sun, Beijing (CN); Liugang Zhou, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 376 days.

(21) Appl. No.: 16/675,386

(22) Filed: Nov. 6, 2019

(65) Prior Publication Data

US 2020/0242994 A1 Jul. 30, 2020

(30) Foreign Application Priority Data

Jan. 29, 2019 (CN) ..... 201910087202.7

(51) Int. Cl.
*G09G 3/20* (2006.01)

(52) U.S. Cl.
CPC ... *G09G 3/2018* (2013.01); *G09G 2310/0202* (2013.01); *G09G 2310/0254* (2013.01); *G09G 2310/08* (2013.01); *G09G 2320/0233* (2013.01)

(58) Field of Classification Search
CPC ..... G09G 3/2018; G09G 2310/0254; G09G 2310/08; G09G 2320/0233; G09G 2310/0202
See application file for complete search history.

(56) References Cited

U.S. PATENT DOCUMENTS 5,742,269 A 4/1998 Hayashiguchi
7,119,770 B2 * 10/2006 Moon ..... G09G 3/30 315/169.3

(Continued)

FOREIGN PATENT DOCUMENTS

CN 1066139 11/1992
CN 101645244 A 2/2010

(Continued)

OTHER PUBLICATIONS

Office action from Chinese Application No. 201910087202.7 dated Jul. 20, 2021.

(Continued)

*Primary Examiner* — Vinh T Lam
(74) *Attorney, Agent, or Firm* — Calfee, Halter & Griswold LLP

(57) ABSTRACT

A display device comprising a plurality of pixels arranged in multiple rows and multiple columns. The multiple pixel columns are connected with a plurality of source signal lines respectively. The pixels of odd-numbered rows in the same pixel column are connected with the source signal lines on a first side of the pixel column. The pixels of even-numbered rows in the same pixel column are connected with the source signal lines on a second side of the pixel column opposite the first side. A display control method comprising the steps of determining and storing target pixel potential data which comprises a target pixel potential for each of the plurality of source signal lines; and setting a potential of each source signal line as the target pixel potential corresponding to the source signal line in an interval zone between two adjacent frames.

10 Claims, 3 Drawing Sheets

(56) References Cited

U.S. PATENT DOCUMENTS

| | | | | |
|---|---|---|---|---|
| 8,049,698 | B2 * | 11/2011 | Koo | G09G 3/3688 345/96 |
| 8,339,423 | B2 * | 12/2012 | Tomizawa | G09G 3/2022 345/89 |
| 8,791,897 | B2 * | 7/2014 | Chui | G09G 3/3466 345/108 |
| 9,886,886 | B2 * | 2/2018 | Amundson | G09G 3/2018 |
| 10,446,077 | B2 * | 10/2019 | Yang | G09G 3/3233 |
| 10,504,464 | B2 * | 12/2019 | Zhang | G09G 3/3677 |
| 10,789,899 | B2 * | 9/2020 | Ikeda | G09G 3/3648 |
| 10,818,258 | B2 * | 10/2020 | Shin | G09G 3/3688 |
| 10,997,934 | B2 * | 5/2021 | Mori | G09G 3/3659 |
| 11,017,736 | B2 * | 5/2021 | Kim | G09G 3/2011 |
| 11,164,492 | B2 * | 11/2021 | Mei | G09G 3/2092 |
| 2008/0042928 | A1 * | 2/2008 | Schlangen | G09G 3/3446 345/55 |
| 2009/0085849 | A1 * | 4/2009 | Chung | G09G 3/3648 345/89 |
| 2009/0167664 | A1 * | 7/2009 | Song | G09G 3/3614 345/94 |
| 2010/0033413 | A1 | 2/2010 | Song et al. | |
| 2010/0315402 | A1 * | 12/2010 | Hashimoto | G09G 3/3677 345/211 |
| 2011/0285759 | A1 * | 11/2011 | Sakai | G09G 3/3648 345/89 |
| 2013/0033476 | A1 * | 2/2013 | Dean | G09G 3/344 345/107 |
| 2015/0123961 | A1 * | 5/2015 | Park | G09G 3/3614 345/212 |
| 2016/0027396 | A1 * | 1/2016 | Li | G09G 3/3614 345/212 |
| 2016/0203775 | A1 * | 7/2016 | Chui | G09G 3/3466 345/209 |
| 2017/0004792 | A1 | 1/2017 | Deng et al. | |
| 2020/0066216 | A1 | 2/2020 | Hu et al. | |
| 2021/0110784 | A1 | 4/2021 | Wang | |

FOREIGN PATENT DOCUMENTS

| | | | | |
|---|---|---|---|---|
| CN | 104361876 | | 2/2015 | |
| CN | 106531114 | | 3/2017 | |
| CN | 106935167 | A * | 7/2017 | G09G 3/006 |
| CN | 107369417 | | 11/2017 | |
| CN | 108198540 | A | 6/2018 | |
| CN | 109243397 | | 1/2019 | |

OTHER PUBLICATIONS

Office Action from Chinese Application No. 201910087202.7 dated Aug. 1, 2022.

* cited by examiner

DISPLAY DEVICE AND DISPLAY CONTROL METHOD AND DISPLAY CONTROL APPARATUS THEREOF

RELATED APPLICATION

This application claims priority to Chinese patent application No. 201910087202.7 filed on Jan. 29, 2019, the entire contents of which are incorporated herein by reference.

TECHNICAL FIELD

This disclosure relates to the field of display technologies, and in particular to a display device and a display control method and display control apparatus thereof.

BACKGROUND

In the related art, a display device panel has an interval zone between two adjacent frames where a polarity reversal (POL reversal) of the display device panel is performed, and after the polarity reversal, the data potential outputted from the source signal line is maintained at a black spot potential. However, when the potential of the first row pixels in the next frame is high (e.g., the gray scale is 255), which considerably differs from the black spot potential and a large-sized panel has a large panel load characteristic, the charging rate of the far-end pixels is insufficient, and as a result, the potential of the first row pixels may not reach a predetermined value, which will lead to a poor dark state of the first row.

SUMMARY

According to a first exemplary embodiment, a display control method of a display device is provided, wherein the display device comprises a plurality of pixels arranged in multiple rows and multiple columns, and the multiple pixel columns are connected with a plurality of source signal lines respectively, and pixels of odd-numbered rows in the same pixel column are connected with the source signal lines on a first side of the pixel column, and pixels of even-numbered rows in the same pixel column are connected with the source signal lines on a second side of the pixel column opposite the first side, the display control method comprising: determining and storing target pixel potential data, wherein the target pixel potential data comprises a target pixel potential for each of the plurality of source signal lines; and setting a potential of each source signal line as the target pixel potential corresponding to the source signal line in an interval zone between two adjacent frames.

According to the display control method of the display device provided in exemplary embodiments, target pixel potential data is determined and stored first, wherein the target pixel potential data comprises a target pixel potential for each of the plurality of source signal lines, and then a potential of each source signal line is set as the target pixel potential corresponding to the source signal line based on the target pixel potential data in an interval zone between two adjacent frames, thereby controlling a pixel potential of each pixel in a first pixel row at the target pixel potential corresponding to the source signal line before the next frame is displayed. Therefore, by controlling the pixel potential of each pixel in the first pixel row at the target pixel potential corresponding to the source signal line in the interval zone, the method in the exemplary embodiments ensures the charging rate of the first row pixels, solves the problem of the first row pixels being too dark, and effectively improves the display effect of the picture.

According to an exemplary embodiment, determining target pixel potential data comprises: detecting pixel potential data of a first pixel row in the next frame, wherein the pixel potential data of the first pixel row comprises a pixel potential of each pixel in the first pixel row; and setting the pixel potential data of the first pixel row in the next frame as the target pixel potential data.

According to an exemplary embodiment, determining target pixel potential data comprises: setting a pixel potential corresponding to a target gray scale as the target pixel potential data.

According to an exemplary embodiment, setting a potential of each source signal line as the target pixel potential corresponding to the source signal line comprises: directly setting a potential of each of the plurality of source signal lines as the target pixel potential corresponding to the source signal line; or gradually setting a potential of each of the plurality of source signal lines as the target pixel potential corresponding to the source signal line in a stepped adjustment mode.

According to an exemplary embodiment, setting a potential of each source signal line as the target pixel potential corresponding to the source signal line in an interval zone between two adjacent frames comprises: in an interval zone between two adjacent frames, setting a potential of each source signal line as the target pixel potential corresponding to the source signal line after a polarity reversal of each pixel in the display device.

In another exemplary embodiment, a display control apparatus of a display device is provided, wherein the display device comprises a plurality of pixels arranged in multiple rows and multiple columns, and the multiple pixel columns are connected with a plurality of source signal lines respectively, and pixels of odd-numbered rows in the same pixel column are connected with the source signal lines on a first side of the pixel column, and pixels of even-numbered rows in the same pixel column are connected with the source signal lines on a second side of the pixel column opposite the first side, the display control apparatus comprising a timing controller and a storage unit, wherein the timing controller is configured for: determining target pixel potential data and storing the target pixel potential data in the storage unit, wherein the target pixel potential data comprises a target pixel potential for each of the plurality of source signal lines, and setting a potential of each source signal line as the target pixel potential corresponding to the source signal line in an interval zone between two adjacent frames.

According to the display control apparatus of the display device provided in the exemplary embodiments, target pixel potential data is determined and stored first, wherein the target pixel potential data comprises a target pixel potential for each of the plurality of source signal lines, and then a potential of each of the plurality of source signal lines is set as the target pixel potential corresponding to the source signal line based on the target pixel potential data in an interval zone between two adjacent frames, thereby controlling a pixel potential of each pixel in a first pixel row at the target pixel potential corresponding to the source signal line before the next frame is displayed. Therefore, by controlling the pixel potential of each pixel in the first pixel row at the target pixel potential corresponding to the source signal line in the interval zone, the method in exemplary embodiments ensures the charging rate of the first row pixels, solves the problem of the first row pixels being too dark, and effectively improves the display effect of the picture.

According to an exemplary embodiment, the timing controller is configured for detecting pixel potential data of a first pixel row in the next frame, wherein the pixel potential data of the first pixel row comprises a pixel potential of each pixel in the first pixel row, and setting the pixel potential data of the first pixel row in the next frame as the target pixel potential data.

According to an exemplary embodiment, the timing controller is configured for setting a pixel potential corresponding to a target gray scale as the target pixel potential data.

According to an exemplary embodiment, the timing controller is further configured for directly setting a potential of each of the plurality of source signal lines as the target pixel potential corresponding to the source signal line; or the timing controller is further configured for gradually setting a potential of each of the plurality of source signal lines as the target pixel potential corresponding to the source signal line in a stepped adjustment mode.

In another exemplary embodiment, a display device is provided, comprising the display control apparatus of the display device.

According to the display device provided in exemplary embodiments, by means of the above display control apparatus, the charging rate of the first row pixels is ensured, the problem of the first row pixels being too dark is solved and the display effect of the picture is improved effectively.

Additional aspects and advantages of this disclosure will partly be described in the following depictions, and some of them will be made obvious through the following depictions or be learned through the practice of this disclosure.

BRIEF DESCRIPTION OF DRAWINGS

The above and/or additional aspects and advantages of this disclosure will become obvious and clear through depictions of the exemplary embodiments with reference to the drawings, wherein.

DETAILED DESCRIPTION

Figure 1:
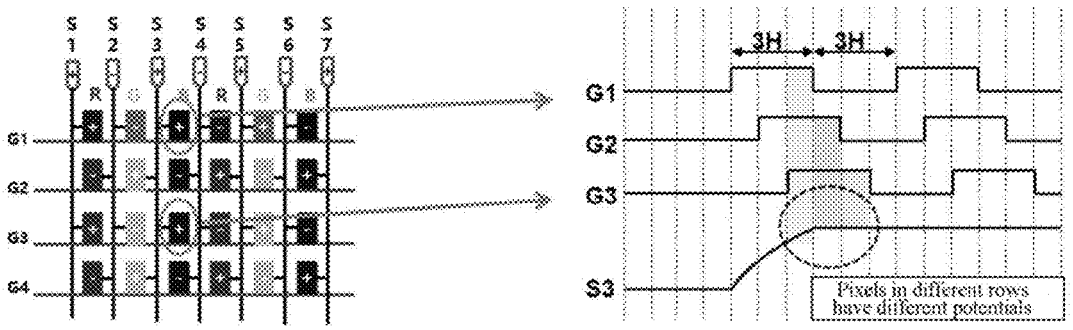
FIG. 1 is a schematic view showing the principle of pixel displays in related art.

The exemplary embodiments of this disclosure will be described in detail and examples of the exemplary embodiments will be shown in the drawings, wherein same or similar signs are used to indicate same or similar elements or elements having same or similar functions throughout the description. The embodiments described below with reference to the drawings are exemplary, and they are only intended for explaining this disclosure, rather than limiting this disclosure.

A display device panel has an interval zone between two adjacent frames where a polarity reversal (POL reversal) of the display device panel is performed, and after the polarity reversal, the data potential outputted by the source signal line is maintained at a black spot potential. For example, as shown in FIG. 1, the problem experienced by related art lies in that when the pixel potential of the first row in the next frame is high (e.g., the gray scale is 255), which is quite different from the black spot potential, and a large-sized panel has a large panel load characteristics, the charging rate of the far-end pixels is insufficient, and as a result, the potential of the first row pixels may not reach a predetermined value, e.g., for the first row pixels G1, the pixel potential of the source signal line S3 cannot reach the predetermined value, so the first row of the panel is too dark, which leads to a poor dark state of the first row.

The display device and the display control method and display control apparatus thereof according to exemplary embodiments will be described with reference to the drawings.

Figure 2:
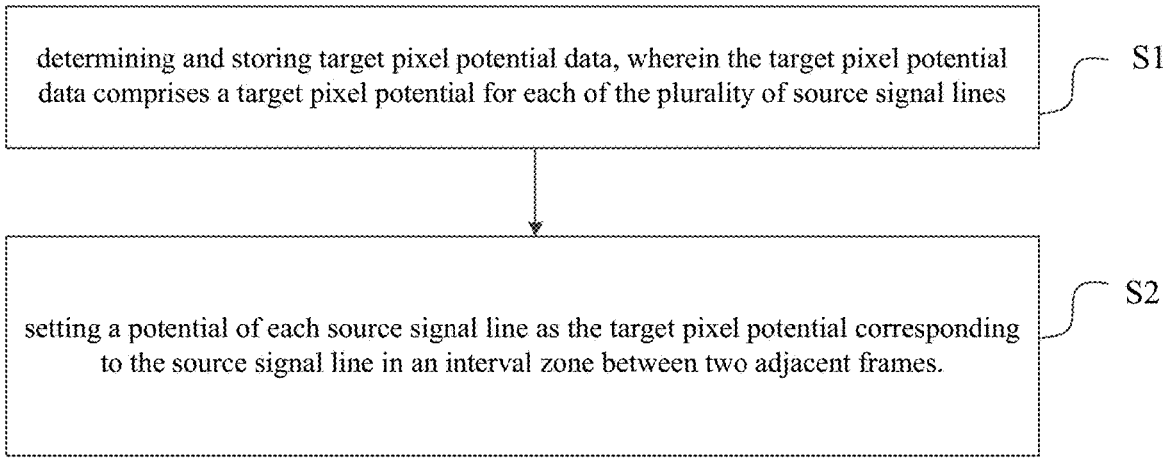
FIG. 2 is a flow chart showing the display control method of the display device according to an exemplary embodiment.

FIG. 2 is a flow chart showing the display control method of the display device according to an exemplary embodiment. The display device comprises a plurality of pixels arranged in multiple rows and multiple columns, and the multiple pixel columns are connected with a plurality of source signal lines respectively, and pixels of odd-numbered rows in the same pixel column are connected with the source signal lines on a first side of the pixel column, and pixels of even-numbered rows in the same pixel column are connected with the source signal lines on a second side of the pixel column opposite the first side. For example, as shown in FIG. 1, in the first pixel column, the pixels of odd-numbered rows are connected with the source signal lines S1 located on the left of the pixel column, and the pixels of even-numbered rows are connected with the source signal lines S2 located on the right of the pixel column.

As shown in FIG. 2, the display control method of the display device according to an exemplary embodiment comprises steps S1 and S2 as follows:

In step S1, target pixel potential data is determined and stored, wherein the target pixel potential data comprises a target pixel potential for each of the plurality of source signal lines.

Figure 3:
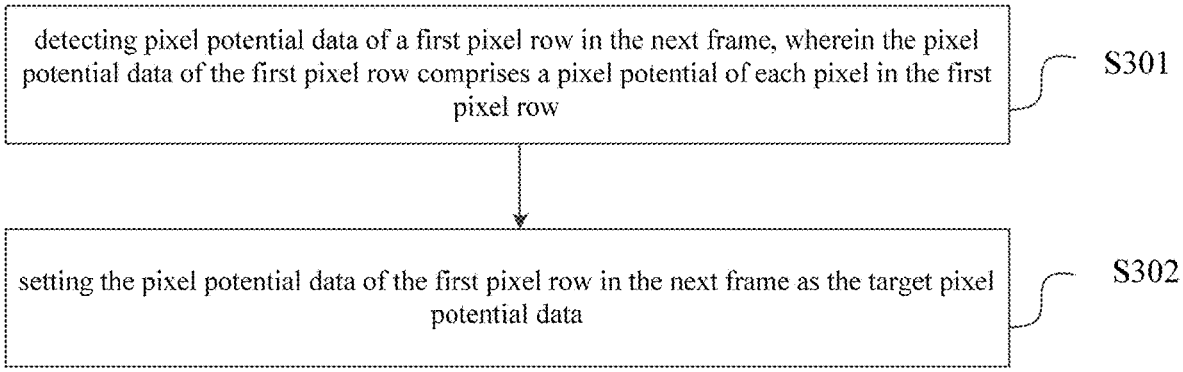
FIG. 3 is a flow chart showing the display control method of the display device according to an exemplary embodiment.

According to an exemplary embodiment, as shown in FIG. 3, determining target pixel potential data (i.e., step S1) may comprise steps S301-S302.

In step S301, pixel potential data of a first pixel row in the next frame is detected, wherein the pixel potential data of the first pixel row comprises a pixel potential of each pixel in the first pixel row.

Each pixel in the first pixel row is connected with a source signal line located on the first side (e.g., on the left as shown in FIG. 1) of the pixel, and thereby the pixel potential of each pixel in the first pixel row is set as a potential of the corresponding source signal line.

It should be noted that the display device comprises a pixel matrix having multiple pixel rows and multiple pixel columns, e.g., an M×N pixel matrix having M pixel rows and N pixel columns, wherein each pixel row has N pixels and each pixel column has M pixels. In an exemplary embodiment, the first pixel row is the earliest to be switched on among the multiple pixel rows, e.g., when M pixel rows are controlled to be switched on row by row, the first pixel row is controlled to be switched on first, and then the other pixel rows are controlled to be switched on sequentially.

In step S302, the pixel potential data of the first pixel row in the next frame is set as the target pixel potential data.

It should be understood that the target pixel potential data may be the pixel potential of all pixels in the first pixel row in the next frame. In other words, the pixel potential of each pixel in the first pixel row in the next frame is namely the target pixel potential for the source signal line corresponding to the pixel. Specifically, a timing controller TCON IC can be used to detect the pixel potential data of each pixel in the first pixel row in the next frame, i.e., the potential of the first row pixels of each source signal line during the display of the next frame, and a storage unit (e.g., a line buffer) can be used to store the pixel potential data of each pixel in the first pixel row in the next frame.

According to an exemplary embodiment, determining target pixel potential data (i.e., step S1) may comprise: setting a pixel potential corresponding to a target gray scale as the target pixel potential data. For example, the target gray scale can be 127.

It should be understood that the target pixel potential data may be a fixed pixel potential, e.g., a pixel potential corresponding to the gray scale of 127. In other words, the target pixel potential for each source signal line is a fixed pixel potential, i.e., the target pixel potential for each source signal line is a pixel potential corresponding to the target gray scale.

Referring back to FIG. 2, in step S2, a potential of each source signal line is set as the target pixel potential corresponding to the source signal line in an interval zone between two adjacent frames.

Furthermore, step S2 may comprise: in an interval zone between two adjacent frames, setting a potential of each source signal line as the target pixel potential corresponding to the source signal line after a polarity reversal of each pixel in the display device.

It should be understood that by setting a potential of each source signal line as the target pixel potential corresponding to the source signal line, the pixel potential of each pixel in the first pixel row can be controlled at the corresponding target pixel potential before the next frame is displayed.

Figure 4:
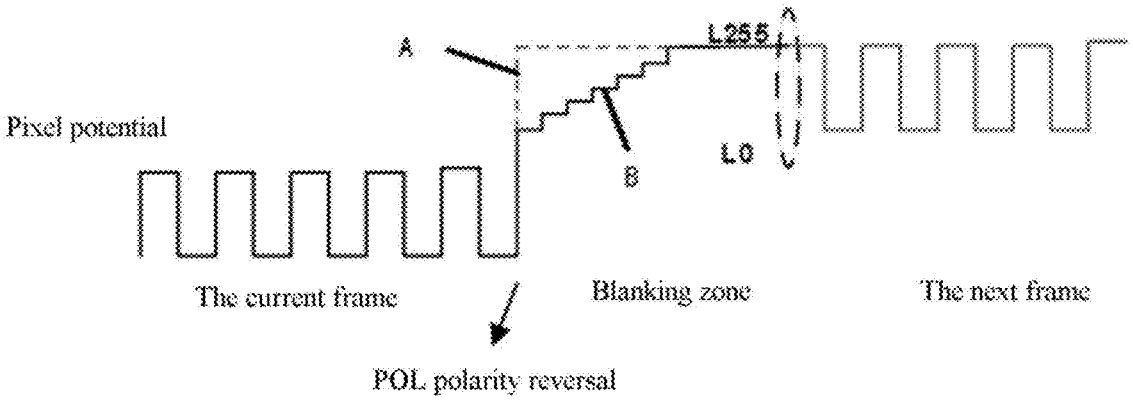
FIG. 4 is a schematic view showing the principle of the display control method of the display device according to an exemplary embodiment.
Figure 5:
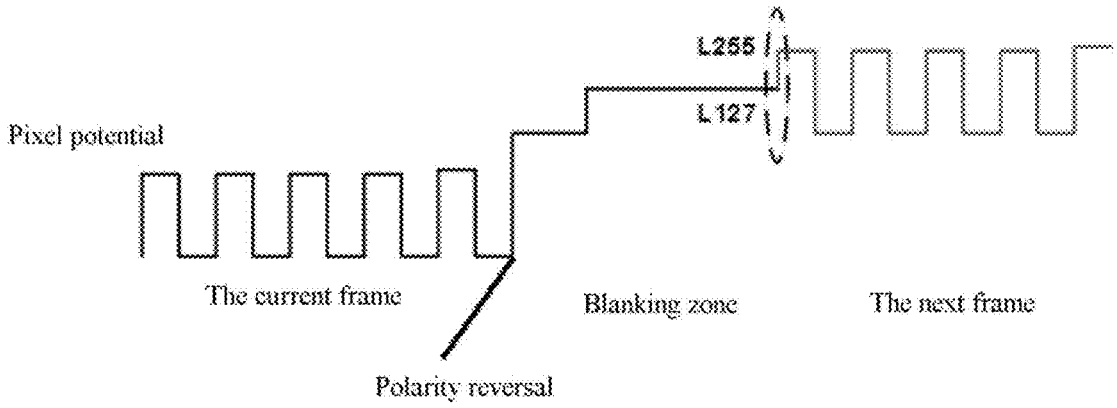
FIG. 5 is a schematic view showing the principle of the display control method of the display device according to an exemplary embodiment.

It should be noted that as shown in FIG. 4 and FIG. 5, there is an interval zone (i.e., a blanking zone) between two adjacent frames, i.e., after the output of the pixel potential data of the last row in the current frame is completed and before the output of the pixel potential data of the first row in the next frame is started, a blanking zone is sandwiched in between.

It should be further noted that the timing controller can provide a data signal and a polarity reversal signal POL to a source drive chip, wherein the data signal is used for indicating pixel potential data, and the polarity reversal signal POL is used for indicating a polarity of the pixel. Upon receipt of the polarity reversal signal POL, the source drive chip generates pixel potential data of different polarities based on the data signal and the polarity reversal signal POL outputted by the timing controller, so as to drive the corresponding pixel. Besides, the value of the polarity reversal signal POL will vary with the timing of a gate drive chip such that any two adjacent pixels have different polarities.

In an exemplary embodiment, a line buffer can be used to store the target pixel potential data, the target pixel potential data being for example pixel potential data of the first pixel row in the next frame or a pixel potential corresponding to a preset gray scale. After that, the potential of each source signal line is varied in the blanking zone, and specifically, in the blanking zone, after the polarity reversal is completed according to the polarity reversal signal POL, the potential of each source signal line is pulled toward the potential of the first row pixels in the next frame or toward the pixel potential corresponding to the target gray scale. For example, the current frame has a gray scale of 255, and the next frame has a gray scale of 63, and the timing controller TCON IC can control the pixel potential to be lowered to the potential of the gray scale of 63 in the blanking zone. In this way, when the next frame is displayed normally, the potential of the first row pixels can substantially reach the predetermined value, which ensures the charging rate of the first row pixels, solves the problem of the first row being too dark and effectively improves the display effect of the picture.

According to an exemplary embodiment, step S2 may comprise: directly setting a potential of each of the plurality of source signal lines as the target pixel potential corresponding to the source signal line; or gradually setting a potential of each of the plurality of source signal lines as the target pixel potential corresponding to the source signal line in a stepped adjustment mode.

In an exemplary embodiment, when the pixel potential data of the first pixel row in the next frame is set as the target pixel potential data, step S2 may comprise: directly setting a potential of each of the plurality of source signal lines as the pixel potential of the corresponding pixel in the first pixel row in the next frame respectively; or gradually setting a potential of each of the plurality of source signal lines as the pixel potential of the corresponding pixel in the first pixel row in the next frame respectively in a stepped adjustment mode.

In other words, in a case where the potential of each source signal line is controlled at the pixel potential of the corresponding pixel in the first pixel row in the next frame respectively, the control of the potential of each source signal line can be implemented in two ways as shown in FIG. 4. In way A as shown in FIG. 4, after the polarity reversal, the potential of each source signal line is directly adjusted to the pixel potential of the corresponding pixel; in way B as shown in FIG. 4, after the polarity reversal, a potential of each source signal line is adjusted to the pixel potential of the corresponding pixel in a stepped adjustment mode such that the pixel potential can be raised or lowered gradually, thereby avoiding large ripples.

As an example, the adjustment parameters of the stepped adjustment mode may be controlled by the timing controller TCON IC. More specifically, the adjustment parameters of the stepped adjustment mode may be determined by the pixel potential of the corresponding pixel of the first pixel row in the next frame, wherein the adjustment parameters may include the order and/or amplitude of the adjustment. The order may indicate the number of adjustments required for reaching the corresponding pixel potential, and the amplitude may indicate the amount of variation in the corresponding pixel potential for each adjustment.

Figure 6:
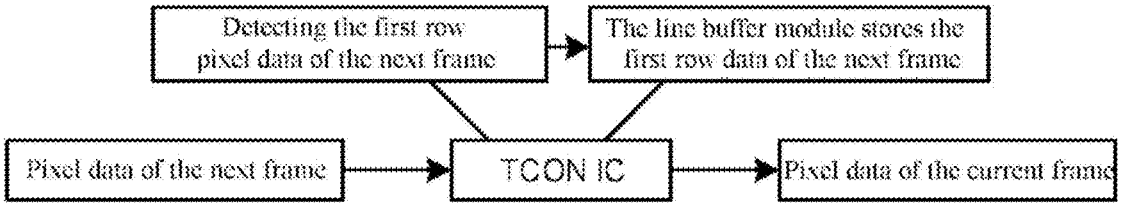
FIG. 6 is a diagram showing the principle of the display control method of the display device according to an exemplary embodiment.

As mentioned above, with reference to FIG. 6, when the pixel potential data of the first pixel row in the next frame is set as the target pixel potential data, the display control method comprises: after finishing controlling the current frame to be outputted based on the pixel data of the current frame, the timing controller TCON IC detecting pixel data of the first row in the next frame (i.e., the pixel potential data of the first row of each source signal line in the next frame), and storing the pixel data of the first row in the next frame by the line buffer. After that, in the blanking zone, each source signal line climbs toward the corresponding pixel potential after the polarity reversal, wherein the pixel potential of each source signal line may be controlled to climb in a stepped adjustment mode. Therefore, when the first row pixel data of the next frame is outputted, each source signal line has reached the corresponding pixel potential, which can solve the problem of the first row pixel being too dark, and effectively improve the display effect of the picture.

In a further exemplary embodiment, when the pixel potential corresponding to a preset gray scale is used as the target pixel potential data, step S2 may comprise: directly setting a potential of each of the plurality of source signal lines as the pixel potential corresponding to the target gray scale; or gradually setting a potential of each of the plurality of source signal lines as the pixel potential corresponding to the target gray scale in a stepped adjustment mode.

In other words, in a case where a gray scale of 127 is inserted after the polarity reversal, the control of the potential of each source signal line can be implemented in two ways as shown in FIG. 5. As shown in FIG. 5, after the polarity reversal, the potential of each source signal line can be directly adjusted to the pixel potential corresponding to the preset gray scale; alternatively, a potential of each source signal line can be adjusted to the pixel potential corresponding to the preset gray scale in a stepped adjustment mode such that the pixel potential can be raised or lowered gradually, thereby avoiding large ripples.

Besides, it should be noted that the charging problem of pixel rows other than the first pixel row in the same frame may be solved by known functions.

To sum up, according to the display control method of the display device provided in the exemplary embodiments, target pixel potential data is determined and stored first, wherein the target pixel potential data comprises a target pixel potential for each of the plurality of source signal lines; and then a potential of each source signal line is set as the target pixel potential corresponding to the source signal line based on the target pixel potential data in an interval zone between two adjacent frames, thereby controlling a pixel potential of each pixel in a first pixel row at the corresponding target pixel potential before the next frame is displayed. Therefore, according to the method in exemplary embodiments, by controlling the pixel potential of each pixel in the first pixel row at the corresponding target pixel potential in the interval zone, the charging rate of the first row pixels is ensured, and the problem of the first row pixels being too dark is solved, and the display effect of the picture is effectively improved.

In order to implement the above embodiments, exemplary embodiments further provide a display control apparatus.

Figure 7:
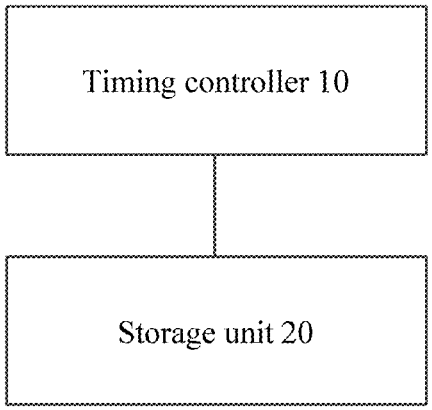
FIG. 7 is a schematic diagram of the display control apparatus according to an exemplary embodiment.

FIG. 7 is a schematic diagram of the display control apparatus according to an exemplary embodiment. The display device comprises a plurality of pixels arranged in multiple rows and multiple columns, and the multiple pixel columns are connected with a plurality of source signal lines respectively, and pixels of odd-numbered rows in the same pixel column are connected with the source signal lines on a first side of the pixel column, and pixels of even-numbered rows in the same pixel column are connected with the source signal lines on a second side of the pixel column opposite the first side. As shown in FIG. 7, the display control apparatus comprises a timing controller 10 and a storage unit 20.

The timing controller 10 is configured for: determining target pixel potential data and storing the target pixel potential data in the storage unit 20, wherein the target pixel potential data comprises a target pixel potential for each of the plurality of source signal lines, and setting a potential of each source signal line as the target pixel potential corresponding to the source signal line in an interval zone between two adjacent frames.

According to an exemplary embodiment, the timing controller 10 is further configured for: detecting pixel potential data of a first pixel row in the next frame, wherein the pixel potential data of the first pixel row comprises a pixel potential of each pixel in the first pixel row, and setting the pixel potential data of the first pixel row in the next frame as the target pixel potential data.

According to an exemplary embodiment, the timing controller 10 is further configured for setting a pixel potential corresponding to a target gray scale as the target pixel potential data.

According to an exemplary embodiment, the timing controller 10 is further configured for directly setting a potential of each of the plurality of source signal lines as the target pixel potential corresponding to the source signal line; or gradually setting a potential of each of the plurality of source signal lines as the target pixel potential corresponding to the source signal line in a stepped adjustment mode.

It should be noted that the above explanations for the exemplary embodiments of the display control method of the display device are also applicable to the display control apparatus described in the exemplary embodiments, which will not be repeated for simplicity.

According to the display control apparatus provided in the exemplary embodiments of this disclosure, target pixel potential data is determined and stored first, wherein the target pixel potential data comprises a target pixel potential for each of the plurality of source signal lines; and then a potential of each of the plurality of source signal line is set as the target pixel potential corresponding to the source signal line based on the target pixel potential data in an interval zone between two adjacent frames, thereby controlling a pixel potential of each pixel in a first pixel row at the corresponding target pixel potential before the next frame is displayed. Therefore, according to the display control apparatus disclosed in exemplary embodiments, by controlling the pixel potential of each pixel in the first pixel row at the corresponding target pixel potential in the interval zone, the charging rate of the first row pixels is ensured, and the problem of the first row pixels being too dark is solved, and the display effect of the picture is effectively improved.

Based on the above exemplary embodiments, this disclosure further provides a display device, comprising the display control apparatus as described in the above exemplary embodiments.

According to the display device provided in exemplary embodiments, by means of the above display control apparatus, the charging rate of the first row pixels is ensured, the problem of the first row pixels being too dark is solved and the display effect of the picture is improved effectively.

In the depiction of this disclosure, terms such as "an embodiment", "some embodiments", "an example", "a specific example" or "some examples" are intended to mean that specific features, structures, materials or characteristics described with reference to the embodiment or example are comprised in at least one embodiment or example of this disclosure. In this disclosure, schematic expressions of the above terms do not necessarily refer to the same embodiment or example. Moreover, specific features, structures, materials or characteristics described thereby can be combined in a suitable manner in any one or more embodiments or examples. Besides, where no contradiction is caused, those skilled in the art can combine and assemble different embodiments or examples described in this disclosure and features of different embodiments or examples.

In addition, terms such as "first" and "second" are used only for descriptive purposes and should not be construed as indicating or implying relative importance or hinting at the number of the indicated technical features. Thereby, features defined by "first" and "second" can comprise at least one such features explicitly or implicitly. In the depiction of this disclosure, "multiple" means at least two, e.g., two, or three, unless defined otherwise explicitly and specifically.

Any process or method description described in the flow charts or described otherwise herein can be understood to represent a module, segment or portion of codes comprising one or more executable instructions for implementing the steps of a customized logic function or process, and the scope of the preferred embodiments of this disclosure includes further implementations, in which the functions may not be performed in the order shown or discussed, including in a substantially simultaneous manner or in an inverse order depending on the functions involved. This should be understood by those skilled in the art to which the embodiments of the present disclosure pertain.

Logic and/or steps represented in the flowchart or described otherwise herein, for example, may be considered as an ordered list of executable instructions for implementing logical functions, and may be embodied in any computer readable medium, for use in an instruction execution system, apparatus, or device (e.g., a computer-based system, a system including a processor, or other systems that can fetch instructions from an instruction execution system, apparatus, or device and execute the instructions), or for use in combination with the instruction execution system, apparatus, or device. For this disclosure, "a computer readable medium" can be any device that can comprise, store, communicate, propagate, or transport programs for use in an instruction execution system, apparatus, or device, or for use in combination with the instruction execution system, apparatus, or device. More specific examples (a non-exhaustive list) of the computer readable medium include: an electrical connection (an electronic device) having one or more wires, a portable computer disk cartridge (a magnetic device), a random access memory (RAM), a read only memory (ROM), an erasable programmable read only memory (EPROM or flash memory), a fiber optic device, and a portable compact disk read only memory (CDROM). In addition, the computer readable medium may even be paper or other suitable medium on which the programs can be printed since the programs can be obtained electronically (for example by optical scanning of the paper or other medium, followed by editing, interpretation or processing in other suitable manners if necessary), and then stored in a computer memory.

It should be understood that each part of this disclosure may be implemented by hardware, software, firmware or a combination thereof In the above implementations, multiple steps or methods may be implemented by software or firmware stored in a memory and executed by a suitable instruction execution system. For example, if implemented in hardware, they can be implemented by any one or combination of the following techniques well known in the art: a discrete logic circuit with logic gates for implementing logic functions on data signals, a dedicated integrated circuit with suitable combinational logic gates, a programmable gate array (PGA), a field programmable gate array (FPGA), and the like.

One having ordinary skills in the art can understand that all or part of the steps carried by the method for implementing the above embodiments can be completed by related hardware instructed by programs. The programs can be stored in a computer readable storage medium and comprise one of the steps of the method embodiments or a combination thereof when executed.

In addition, the functional units in each exemplary embodiment may be integrated into one processing module, or each unit may exist physically and independently, or two or more units may be integrated into one module. The integrated module may be implemented either in the form of hardware or in the form of a software functional module. The integrated module may also be stored in a computer readable storage medium if it is implemented in the form of a software functional module and sold or used as an independent product.

The storage medium mentioned above may be a read only memory, a magnetic disk or an optic disk, etc. Although the embodiments of this disclosure have been shown and described, it can be understood that the embodiments are exemplary, and they cannot be construed as limiting this disclosure. One having ordinary skills in the art can vary, change, substitute and modify the above exemplary embodiments within the scope of this disclosure.

The invention claimed is:

1. A display control method of a display device, wherein the display device comprises a plurality of pixels arranged in multiple rows and multiple columns, and the multiple pixel columns are connected with a plurality of source signal lines respectively, and pixels of odd-numbered rows in the same pixel column are connected with the source signal lines on a first side of the pixel column, and pixels of even-numbered rows in the same pixel column are connected with the source signal lines on a second side of the pixel column opposite the first side, the display control method comprising:

determining and storing target pixel potential data, wherein the target pixel potential data comprises a target pixel potential for each of the plurality of source signal lines; and setting a potential of each source signal line as the target pixel potential corresponding to the source signal line in an interval zone between two adjacent frames, wherein determining target pixel potential data comprises;

detecting pixel potential data of a first pixel row in the next frame, wherein the pixel potential data of the first pixel row comprises a pixel potential of each pixel in the first pixel row; and setting the pixel potential data of the first pixel row in the next frame as the target pixel potential data.

2. The display control method of the display device according to claim 1, wherein determining target pixel potential data comprises:

setting a pixel potential corresponding to a target gray scale as the target pixel potential data.

3. The display control method of the display device according to claim 1, wherein setting a potential of each source signal line as the target pixel potential corresponding to the source signal line comprises:

directly setting a potential of each of the plurality of source signal lines as the target pixel potential corresponding to the source signal line; or gradually setting a potential of each of the plurality of source signal lines as the target pixel potential corresponding to the source signal line in a stepped adjustment mode.

4. The display control method of the display device according to claim 1, wherein setting a potential of each source signal line as the target pixel potential corresponding to the source signal line in an interval zone between two adjacent frames comprises:

in an interval zone between two adjacent frames, setting a potential of each source signal line as the target pixel potential corresponding to the source signal line after a polarity reversal of each pixel in the display device.

5. A display control apparatus of a display device, wherein the display device comprises a plurality of pixels arranged in multiple rows and multiple columns, and the multiple pixel columns are connected with a plurality of source signal lines respectively, and pixels of odd-numbered rows in the same pixel column are connected with the source signal lines on a first side of the pixel column, and pixels of even-numbered rows in the same pixel column are connected with the source signal lines on a second side of the pixel column opposite the first side, the display control apparatus comprising a timing controller and a storage unit, wherein the timing controller is configured for:

determining target pixel potential data and storing the target pixel potential data in the storage unit, wherein the target pixel potential data comprises a target pixel potential for each of the plurality of source signal lines, and setting a potential of each source signal line as the target pixel potential corresponding to the source signal line in an interval zone between two adjacent frames, wherein the timing controller is configured for;

detecting pixel potential dat aof a first pixel row in the next frame, wherein the pixel potential data of the first pixel row comprises a pixel potential of each pixel in the first pixel row, and setting the pixel potential data of the first pixel row in the next frame as the target pixel potential data.

6. The display control apparatus according to claim 5, wherein the timing controller is configured for setting a pixel potential corresponding to a target gray scale as the target pixel potential data.

7. The display control apparatus according to claim 5, wherein the timing controller is further configured for:

directly setting a potential of each of the plurality of source signal lines as the target pixel potential corresponding to the source signal line; or gradually setting a potential of each of the plurality of source signal lines as the target pixel potential corresponding to the source signal line in a stepped adjustment mode.

8. A display device comprising the display control apparatus according to claim 5.

9. The display device according to claim 8, wherein the timing controller is configured for setting a pixel potential corresponding to a target gray scale as the target pixel potential data.

10. The display device according to claim 8, wherein the timing controller is further configured for:

directly setting a potential of each of the plurality of source signal lines as the target pixel potential corresponding to the source signal line; or gradually setting a potential of each of the plurality of source signal lines as the target pixel potential corresponding to the source signal line in a stepped adjustment mode.

* * * * *